United States Patent [19]

Bringhurst

[11] 4,351,235

[45] Sep. 28, 1982

[54] DOT PRINTING MECHANISM FOR DOT MATRIX LINE PRINTERS

[75] Inventor: Edward D. Bringhurst, Seattle, Wash.

[73] Assignee: Mannesmann Tally Corporation, Kent, Wash.

[21] Appl. No.: 186,134

[22] Filed: Sep. 11, 1980

[51] Int. Cl.[3] ..... B41J 3/12

[52] U.S. Cl. ..... 101/93.04; 400/121

[58] Field of Search ..... 400/121, 124; 101/93.04, 93.05, 93.09

[56] References Cited

U.S. PATENT DOCUMENTS

| | | | |
|---|---|---|---|
| Re. 29,745 | 8/1979 | Gomi | 101/93.29 |
| 3,672,482 | 6/1972 | Brumbaugh et al. | 197/1 R |
| 3,745,495 | 7/1973 | Chai et al. | 335/229 |
| 3,822,005 | 7/1974 | Murat | 197/1 R |
| 3,836,880 | 9/1974 | Matschke et al. | 400/124 X |
| 3,967,714 | 7/1976 | Potma et al. | 197/1 R |
| 4,030,590 | 6/1977 | Wojdyla | 197/1 R |
| 4,044,668 | 8/1973 | Barrus et al. | 101/93.04 |
| 4,167,343 | 9/1979 | Golobay | 400/124 |
| 4,218,149 | 8/1980 | Okada | 400/124 |
| 4,233,894 | 11/1980 | Barrus et al. | 101/93.09 |

*Primary Examiner*—Paul T. Sewell

*Attorney, Agent, or Firm*—Christensen, O'Connor, Johnson & Kindness

[57] ABSTRACT

A dot printing mechanism for dot matrix line printers comprising a plurality of hammer modules (45) mounted on a carriage (43) that is shuttled back and forth along a print line is disclosed. Each module includes a plurality of cantilevered print hammers (47) formed of a resilient ferromagnetic material. Each of the print hammers includes an anvil (49) on one face of its cantilevered outer end, adapted to print a dot when the associated hammer is actuated. The modules (45) are mounted on opposite sides of the print line and positioned such that the hammers (47) of juxtaposed modules are interleaved and such that the anvils (49) all lie along the print line. Further, each hammer forms part of a magnetic circuit that includes a permanent magnet (51), a post (57) and ferromagnetic paths between the permanent magnet and post. The post supports a coil (59) and is positioned near the cantilevered end of the print hammer (47), on the side opposite of the anvil (49). In the absence of current through the coil (59), the print hammer (47) is attracted to the post by the magnetic field produced by the permanent magnet (51) and, thus, cocked. The cocked hammers (47) are selectively released to create dots by the selective energization the coils. The selective energization is such that the coils (59) produce a magnetic field that counteracts the magnetic post attraction force created by the permanent magnet (51).

20 Claims, 8 Drawing Figures

DOT PRINTING MECHANISM FOR DOT MATRIX LINE PRINTERS

TECHNICAL AREA

This invention relates to dot matrix printers and, in particular, dot matrix line printers.

BACKGROUND OF THE INVENTION

In general, dot matrix printers can be separated into two types of printers—line printers and serial printers. Both types of printers create images (characters or designs) by selectively printing a series of dots in an x-y matrix. A serial dot matrix printer includes a head that is moved back and forth across a sheet of paper, either continuously or by steps. The head includes a column of dot printing elements. As each column position of a character position is reach during printing, the required number of dot printing elements are actuated to form dots. A series of thusly created dot columns forms the desired character. Contrariwise, line printers include dot printing mechanisms for creating lines of dots substantially simultaneously as paper is stepped through the printer. A series of lines of dots creates an image, i.e., a row of characters or a design. The present invention is related to dot matrix line printers, as opposed to serial dot matrix printers.

In the past, various types of dot printing mechanisms for use in dot matrix line printers have been proposed and used. In one such printing mechanism a print comb, comprising a plurality of cantilevered print hammers formed of a resilient ferromagnetic material, is mounted on a carriage. The carriage shuttles the print comb back and forth in front of a plurality of electromagnets positioned so as to be able to selectively actuate the hammers. Hammer actuation is created by energizing the electromagnets to pull the free ends of the hammers away from the plane of the print comb and then releasing the thusly cocked hammers by de-energizing the energized electromagnets. The released hammers fly forward through the plane of the print comb and create a dot on the paper. Shuttling of the print comb results in each hammer "scanning" a predetermined number of dot positions of the overall print line. At each dot position, as required, the appropriate hammers are actuated to create dots in the manner heretofore described. After shuttling in one direction, the paper is indexed and the print comb is shuttled in the opposite direction, whereby the next line is scanned. A more detailed description of a printer that functions in this manner is set forth in U.S. Pat. No. 3,782,278, entitled, IMPACT LINE PRINTER assigned to Tally Corporation, Kent, Wash., the assignee of the present application.

As to be appreciated from the foregoing summary description the actuating electromagnets are mounted in a fixed position and only the print hammers are shuttled back and forth in a printer of the type described in U.S. Pat. No. 3,782,278. Alternative to a dot printing mechanism wherein only the print hammers are shuttled is one wherein the print hammer actuating mechanism as well as the print hammers are shuttled. A dot matrix line printer utilizing this approach is described in U.S. Pat. No. 3,941,051, entitled, PRINTER SYSTEM, by Gordon B. Barrus, et al. In addition to shuttling the hammer actuators as well as the hammers back and forth, U.S. Pat. No. 3,941,051 discloses the use of a permanent magnet to maintain the hammers cocked. The cocked hammers are released and their stored energy utilized to create a dot by the application of electrical energy to a coil wound around a pole piece to which the free end of the hammers are attracted. The coil creates a magnetic field that counteracts the permanent magnet field force such that the related cocked hammer is released. The present invention is directed to an improved and different type of dot printing mechanism for dot matrix line printers wherein the print hammer actuating mechanism as well as the print hammers are shuttled and wherein the print hammers are cocked by the magnetic field produced by a permanent magnet and released when a counteracting magnetic field is produced by an electromagnet.

Therefore, it is an object of this invention to provide a new and improved dot printing mechanism for dot matrix line printers.

It is another object of this invention to provide a new and improved dot printing mechanism for dot matrix line printers wherein the print hammer actuators as well as the print hammers are shuttled back and forth.

It is yet another object of this invention to provide a new and improved dot printing mechanism for dot matix line printers that utilizes permanent magnets to cock the print hammers, which are released upon the application of electrical energy to a release coils positioned so as to conteract the print hammer magnetic retraction force produced by the permanent magnets.

SUMMARY OF THE INVENTION

In accordance with this invention a dot printing mechanism for dot matrix line printers is provided. The dot printing mechanism comprises a plurality of hammer modules mounted on a carriage that is shuttled back and forth along a print line. Each module includes a plurality of cantilevered print hammers. Each print hammers includes an anvil adapted to print a dot when the hammer is actuated. The modules are mounted on opposite sides of the print line, such that the anvils all lie along the print line. Further, the modules are positioned such that the hammers of juxtaposed modules are interleaved. Each print hammer is formed of a resilient ferromagnetic material and forms part of an actuating magnetic circuit. The actuating magnetic circuits include a permanent magnet, a post and ferromagnetic paths between the permanent magnet and the post, including the ferromagnetic path provided by the print hammer. Each post supports a coil and is positioned near the cantilevered end of the associated print hammer, on the opposite side of the print hammer from the anvil. In the absence of current through the coil, the print hammer is magnetically attracted to the post by the magnetic field produced by the permanent magnet and, thus, cocked. Cocked print hammers are selectively released to create dots by the selective energization of the coils wrapped around the posts. More specifically, the magnetic field produced by the energized coils counteracts the magnetic attraction force created by the magnetic field of the permanent magnet. The counteracting field strength is adequate for the resilient force of the hammer (e.g., its cocked stored energy) to overcome the permanent magnet field force, whereby the hammer is released to create a dot.

In accordance with other features of this invention, preferably, each module includes an elongate permanent magnet having a pair of opposed longitudinal parallel faces. The permanent magnet is cross-sectionally polarized such that the longitudinal parallel faces form the poles of the magnet. Mounted on one longitudinal face of the elongate permanent magnet is a ferromagnetic flux plate that extends orthogonally outwardly from the elongate permanent magnet. The coil posts are attached to the outer end of the flux plate so as to overlie the elongate permanent magnet. Mounted on the other longitudinal face of the permanent magnet is a ferromagnetic return plate. The return plate lies parallel to the flux plate and terminates short of the coil posts such that a gap exists between the end of the return plate and the tip of the posts. The hammers are mounted on the opposite side of the return plate from the permanent magnet; and, are spaced therefrom along a substantial portion of the length of the hammers. A stiffener is mounted on the outer ends of each of the hammers so as to face the tip of the associated post. The stiffeners are formed of a ferromagnetic material and support the print anvils on the sides thereof opposite to the sides facing the posts. A portion of the stiffener fills the gap between return plate and the tips of the associated post. The stiffeners are thus a major portion of the flux path between the coil posts and the return plate.

In accordance with further features of this invention, preferably, the flux plate includes a plurality of parallel slots that separate the flux plate into a plurality of outwardly extending arms, equal in number to the number of hammers. One post is mounted in each arm on the outer end thereof. In addition, preferably, the return plate is slotted so as to have a plurality of outwardly extending arms equal in number to the number of hammers and posts, one of said arms being aligned with each of said posts. In addition, preferably, the outer ends of the arms of the return plate are undercut so as to provide projecting legs substantially equal in width to the diameter of the posts. Also, preferably, the hammers are formed of a unitary plate having a plurality of arms, each of said arms forming a hammer.

It will be appreciated from the foregoing description that the invention provides a new and improved dot printing mechanism for dot matrix line printers. The interleaved modular print mechanism of the invention has a number of structural advantages over single sided line printer mechanisms of the type described in U.S. Pat. No. 3,941,051. In addition, the lack of a plate between the hammers and the print receiving medium results in improved flux flow through the hammers and, thus, increases hammer cocking force. As a result, the magnetic field produced by the permanent magnet can be made smaller, whereby smaller magnets or magnets of lower field strength can be used. That is, because the spring pull force is increased due to the lack of a front plate, the magnetic intensity required to create a predetermined amount of hammer cocking force is decreased, whereby smaller magnets or magnets with lower field strength can be used without a deterioration in print quality occurring. Further, because magnet size can be decreased, the shuttled mass can be decreased, whereby speed can be increased for the same amount of shuttle energy input.

BRIEF DESCRIPTION OF THE DRAWINGS

The foregoing objects and many of the attendant advantages of this invention become more readily appreciated as the same becomes better understood by reference to the following detailed description when taken in conjunction with the accompanying drawings wherein.

DESCRIPTION OF THE PREFERRED EMBODIMENT

Figure 1:
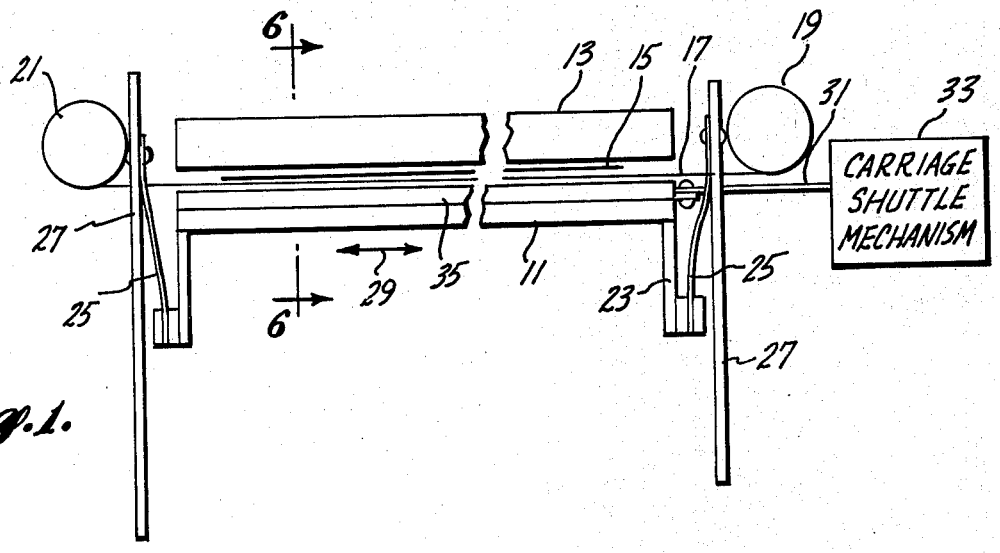
FIG. 1 is a partial pictorial plan view illustrating the major mechanical components of a dot matrix line printer.

FIG. 1 is a plan view illustrating the major mechanical components of a dot matrix line printer. Included in FIG. 1 is an elongate carriage 11 aligned with a platen 13, illustrated as cylindrical. That is, the longitudinal axis of the carriage 11 lies parallel to the longitudinal axis of the platen 13. The platen is spaced from the carriage 11. Lying in the space between the carriage 11 and the platen 13 is a print receiving medium (e.g., paper 15) and a ribbon 17. The paper 15 lies nearest the platen 13 and the ribbon 17 lies nearest the carriage 11. The ribbon 17 is moved from a supply reel 19 to a take-up reel 21 by any one of several well known ribbon movement mechanisms (not shown) and may be cycled back and forth between the two reels. The carriage 11 includes an arm 23 on either end that extends away from the platen 13. The outer tips of the arms 23 are connected by flexures 25 to the frame 27 of the printer. The flexures 25 are mounted such that the carriage 11 is free to move back and forth in a direction parallel to the longitudinal axis of the platen 13, i.e., in the direction illustrated by a double ended arrow 29. One end of the carriage 11 is connected by a link 31 to a carriage shuttle mechanism 33 illustrated in block form in FIG. 1. The carriage shuttle mechanism 33 may include a stepping motor or a continuous motor connected by the link 31 to the carriage 11 so as to shuttle the carriage 11 back and forth in the direction illustrated by the double ended arrow 29.

The carriage 11 supports a dot printing mechanism 35. The printing axis of the dot printing mechanism is radial to the cylindrical platen 13. When actuated, the printing elements of the dot printing mechanism press the ribbon 17 against the paper 15 which, in turn, is pressed against the platen 13. In this manner, a dot is printed each time a dot printing element is actuated. In actual operation, a plurality of dots are smultaneously produced in this manner, as required by the nature of the image (e.g., characters or design) to be printed, along a print line lying parallel to the longitudinal axis of the platen 13. The present invention is directed to a new and improved dot printing mechanism for dot matrix line printers of the type illustrated in FIG. 1.

Figure 2:
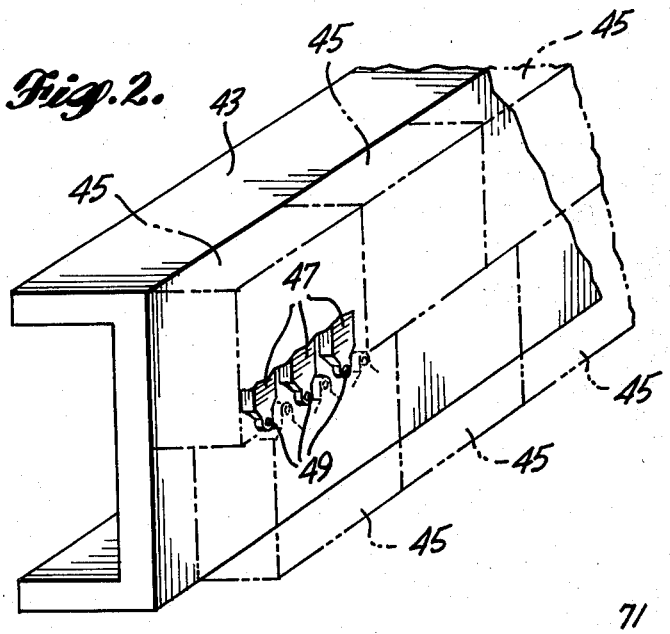
FIG. 2 is a pictorial diagram illustrating the mounting of print hammer modules formed in accordance with the invention.

FIG. 2 illustrates the general nature of a dot printing mechanism formed in accordance with the invention and includes a carriage 43 and a plurality of hammer modules 45 mounted on the carriage. Since the amount of shuttle movement or oscillation energy that must be produced by the carriage shuttle mechanism 33 is directly related to the weight of the carriage to be shuttled, it is desirable that the carriage 43 be formed from a lightweight material of suitable structural strength. In this regard, preferably, the carriage 43 is formed of a lightweight high-strength metal, such as magnesium. Alternatively, since the carriage does not need to be magnetically conductive, it can be a lightweight, high-strength synthetic material, such as a carbon fiber reinforced epoxy formed by pultrusion.

Figure 3:
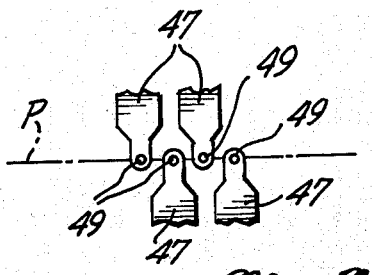
FIG. 3 is a pictorial plan view illustrating the interleaving of the hammers of the modules of a dot printing mechanism formed in accordance with the invention.

Each of the modules 45 includes a plurality of cantilevered print hammers 47. While various numbers of print hammers can be utilized, the modules illustrated in the drawings each include three print hammers 47. Mounted on the cantilevered outer end of each of the print hammers is an anvil 49. The modules 45 are positioned such that the anvils lie along a common print line, denoted P in FIG. 3. In addition, the modules are positioned such that they are alternately arrayed on opposite sides of the print line and such that the hammers of juxtaposed modules are interleaved, as illustrated in FIGS. 2 and 3.

Figure 4:
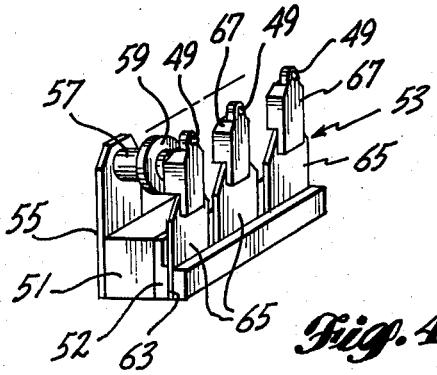
FIG. 4 is a pictorial view of a print hammer module suitable for use in a dot printing mechanism formed in accordance with the invention.
Figure 5:
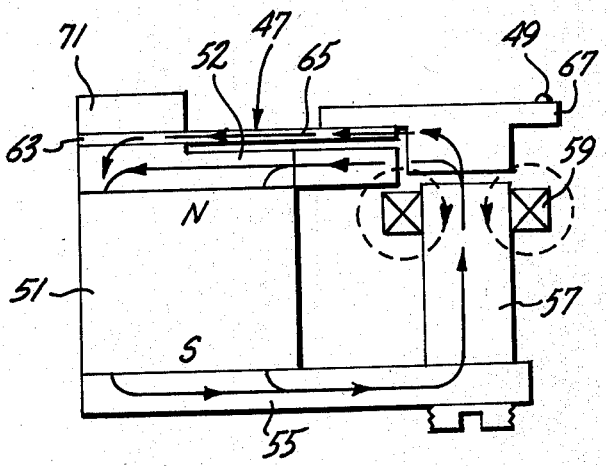
FIG. 5 is a schematic diagram of the magnetic circuit of a print hammer module formed in accordance with the invention.

As illustrated in FIGS. 4 and 5, each print hammer module includes an elongate permanent magnet 51 having a generally rectangular cross-sectional configuration. The polarization of the permanent magnet 51 is such that one pole (e.g., the north pole) of the magnet lies along one longitudinal face and the other pole (e.g., the south pole) lies along the opposed longitudinal face. Preferably the magnets of the modules are polarized in one direction on one side of the print line P and in the opposite direction on the other side. Mounted on one of the polarized faces of the elongated permanent magnet 51 is a return plate 52 and a hammer assembly 53; and, mounted on the other polarized face is a flux plate 55. The return plate 52, the hammer assembly 53 and the flux plate 55 are planar and extend outwardly in parallel planes. Mounted near the outer end of the flux plate 55 are a plurality of posts 57 that extend orthogonally outwardly in the direction of the return plate and the hammer assembly. Wrapped around each post is a coil 59. The return plate 52 is mounted between the permanent magnet 51 and the hammer assembly. The hammer assembly 53 includes three print hammers 47, each of which comprises a hammer arm 65 and a stiffener 67. The hammer arms 65 are unitarily formed with a common base 63. The common base 63 is attached to a raised area of the return plate 52 so that the arms are spaced from the return plate, even though they lie parallel thereto. Mounted on the outer end of each of the print hammer arms 65 is one of the stiffeners 67. The stiffeners 67 overlie the tips of the posts 57, and the anvils 49 are mounted on the faces of the stiffeners 67 remote from the sides thereof facing the posts 57. A clamp plate 71 overlies the common base 63 of the print hammer arms 65. The clamp plate 71 lies parallel to the permanent magnet 51. Relatively long countersunk cap screws 73 pass through aligned apertures in the common base 63, the return plate 52, the permanent magnet 51 and into threaded apertures in the flux plate 55. When tightened, the cap screws 73 hold these parts of the print hammers modules together.

The permanent magnet 51 is formed of a material adapted to produce a high concentration magnetic field, such as INDOX V or VIII. The hammer arms 65 and common base 63 are formed of a high-strength, resilient magnetic material, such as martensite Steel or 1050 Steel. The flux plate 55, the post 57, the return plate 52 and the stiffener 67 are all formed of a soft magnetically permeable material, such as low carbon steel. The clamp 71 may be formed of a nonmagnetic material, such as aluminum or a magnetic material, such as steel.

As will be appreciated by those familiar with magnetic circuits from the foregoing description of the materials utilized to form the hammer modules, each hammer assembly includes first and second magnetic paths, part of which are common. The first magnetic path extends from the permanent magnet 51 through the flux plate 55, the post 57, the stiffener 67 and the return plate 52. The second magnetic path extends from the permanent magnet through the flux plate 55, the post 57, the stiffener 67 and the hammer arm 65. Since the hammer arm 65 is formed of a resilient material, albeit a magnetic material, in the absence of current through the coil 59, the stiffener 67 is attracted to the post 57 by the magnetic field force produced by the permanent magnet. If this magnetic force is sufficiently high, the hammer arms 65 are moved from an unstressed planar position into a stressed bent position whereat the stiffeners impinge on their associates posts. In this position the hammers are defined as cocked because the bent hammer arms store energy in the absence of current through the coils 59. It is this stored energy that creates a dot when the hammers are released. More specifically, when current of an appropriate polarity passes through a coil 59, an electromagnetic field is created that counteracts the attractive permanent magnetic field. In essence, the electromagnetic field causes the permanent magnetic field to jump the gap between the post 57 and the return plate 52, rather than pass through the stiffener 67. The electromagnetic field also increases the air gap leakage flux between the return plate 52 and the flux plate 55 as well as other air gap leakage flux to other nearby ferromagnetic elements. As a result, the attraction force between the stiffener 67 and the tip of the post 57 is reduced. If the reduction is adequate, the energy stored in the arm overcomes the remaining permanent magnet attraction force. When this occurs, the hammer arm 65 rapidly moves the stiffener 67 away from the tip of the post 57. This action causes the stiffener and, thus, the anvil 49 to fly toward the platen. As this occurs, the anvil first presses the ribbon against the paper and, then, both against the platen to create a dot on the paper. The stiffener acts as a flux concentrator for both magnetic paths and, thus, reduces the size of the permanent magnet required to achieve a particular amount of force. The flux concentration provided by the stiffener in the first path (between the post and the return plate ) is as important as the flux concentration provided in the second path (between the post and the hammer arm).

Figure 7:
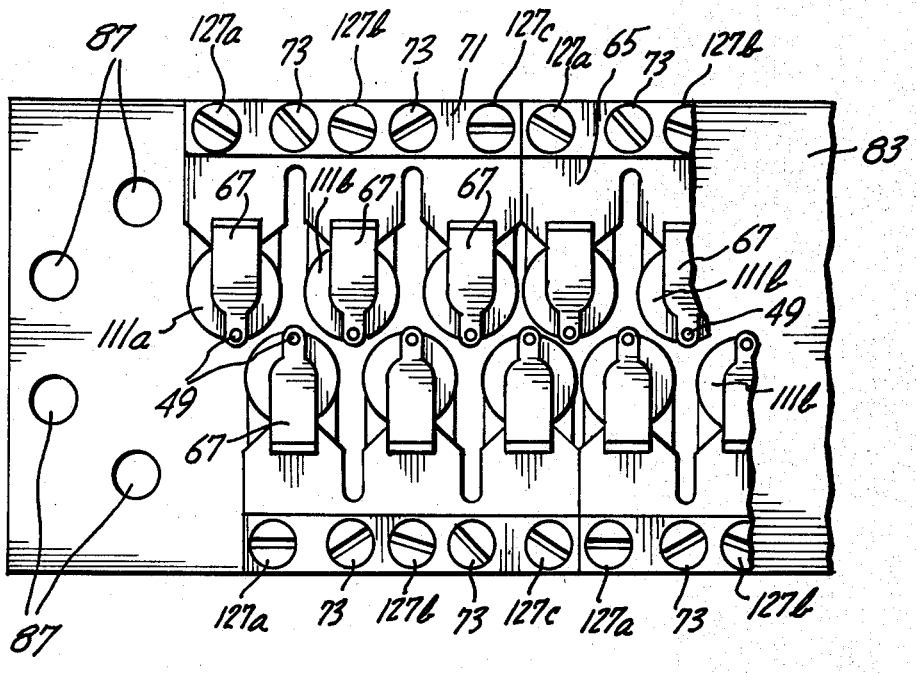
FIG. 7 is a plan view taken along line 7—7 of FIG. 6.
Figure 6:
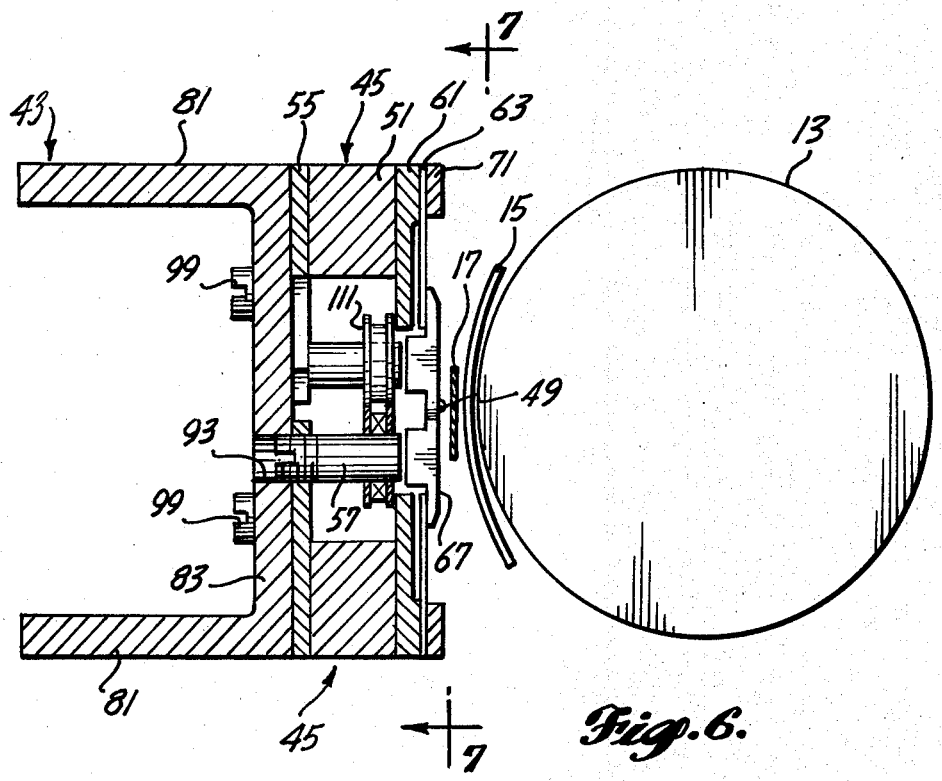
FIG. 6 is a cross-sectional view along line 6—6 of FIG. 1.
Figure 8:
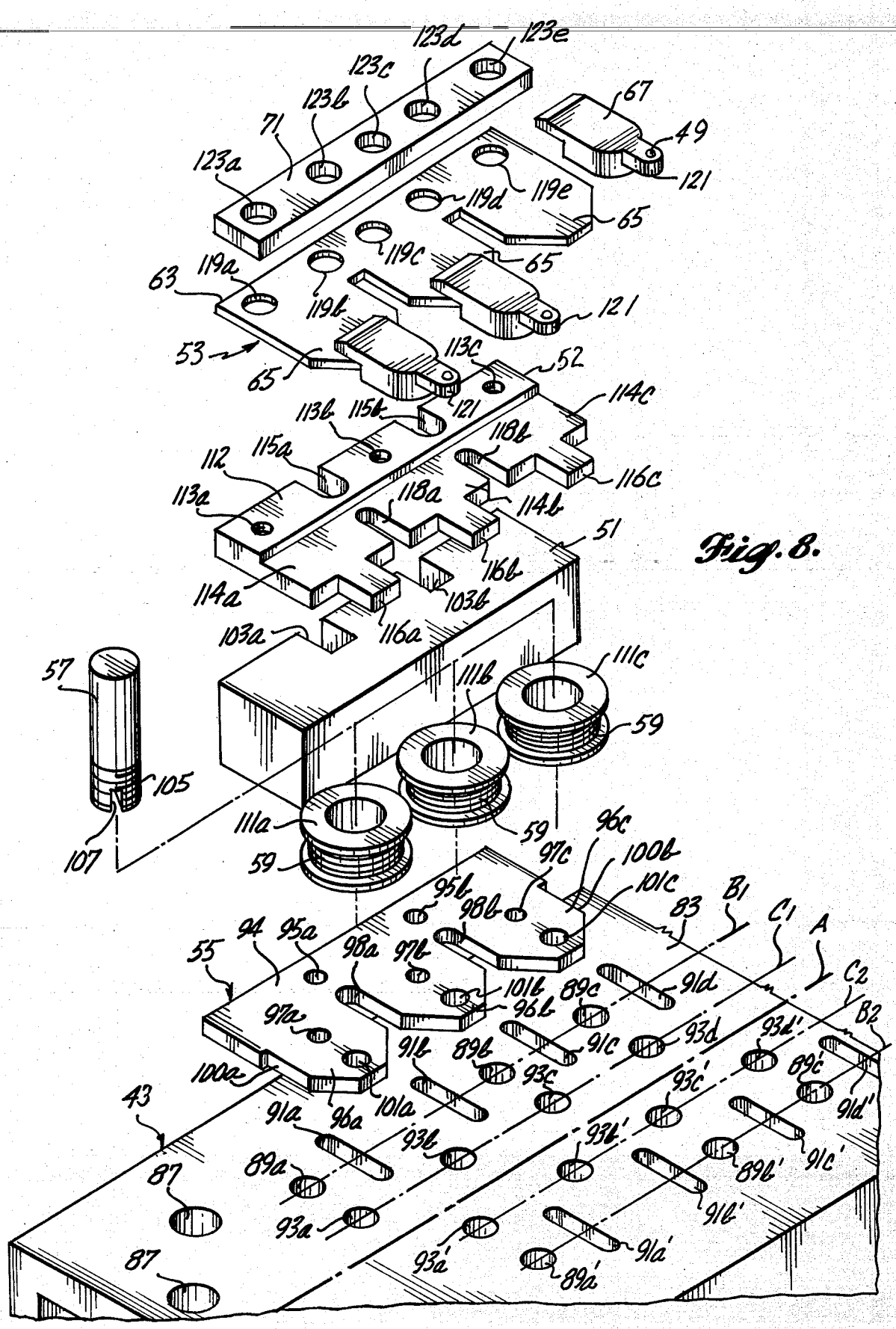
FIG. 8 is an exploded perspective view of a portion of a print hammer module formed in accordance with the invention.

FIGS. 6, 7, and 8 illustrate in more detail a preferred embodiment of the inventon. As best illustrated in FIG. 6, the elongate carriage 43 has a U-shaped cross-sectional configuration that includes a pair of flanges or legs 81 and a unitary cross member 83. As noted above, preferably, the carriage is formed of a lightweight material, such as magnesium or a carbon fiber reinforced epoxy formed by pultrusion. The hammer modules 45 are mounted on the cross member 83 of the carriage 43.

Located near the end of the carriage cross-member 83 (FIG. 7) are apertures 87 for attaching the carriage to arms 23 (FIG. 1) and, thus, to a flexural support mechanism as previously described. Obviously, the number of apertures and the position of the apertures can vary, depending upon the specific manner of attachment. Still further, methods of attachment not requiring apertures can be utilized, if desired.

Located inwardly from each longitudinal edge of the cross member 83 of the carriage 43, are a first plurality of circular holes 89*a*, 89*b*, 89*c*, etc., and 89*a*', 89*b*', 89*c*', etc. The first plurality of holes lie along outer centerlines, denoted B1 and B2, that lie parallel to the longitudinal centerline, denoted A, of the carriage. Located between the first plurality of holes 89*a*, 89*b*, 89*c*, etc. and 89*a*', 89*b*', 89*c*', etc. are slots 91*a*, 91*b*, 91*c*, etc., and 91*a*', 91*b*', 91*c*', etc., whose longitudinal axes lie orthogonal to centerline A. More specifically, the first plurality of holes include pairs of widely spaced holes, e.g., 89*a*, *b*; 89*c*,*d*; 89*e*,*f*; etc., and 89*a*',*b*'; 89*c*',*d*'; 89*e*',*f*'; etc. Each pair of widely spaced holes, e.g., 89*a*, 89*b*, is closely spaced to the next pair of widely spaced holes, e.g., 89*c*, 89*d*. A pair of transverse slots, e.g., 91*a*, 91*b*, lie between the holes that form the pairs of widely spaced holes, e.g., 89*a*, 89*b*, and a single transverse slot, e.g., 91*c*, lies between adjacent pairs of widely spaced holes, e.g., 89*a*, 89*b* and 89*c*, 89*d*. The spacing between the transverse slots is the same regardless of whether they lie between the holes that define the pairs of widely spaced holes or between adjacent pairs of widely spaced holed. Finally, the holes and slots located along the B1 and B2 centerlines are longitudinally offset such that the end hole 89*a*' along the B2 centerline is orthogonally aligned with the end slot 91*a* along the B1 centerline.

Located between the B1 and B2 centerlines and the A centerline on each side of the carriage is a second plurality of holes 93*a*, 93*b*, etc., and 93*a*', 93*b*', etc. The second plurality of holes 93*a*, 93*b* etc., and 93*a*', 93*b*', etc., lie along inner centerlines, denoted C1 and C2, while lie parallel to the B1 and B2 centerlines and, thus, parallel to the A centerline. The second plurality of holes 93*a*, 93*b*, etc., are equally spaced between the transverse slots 91*a*, 91*b*, etc.

As best illustrated in FIG. 8, the flux plates 55 of the hammer modules 45 are flat. As previously described, the flux plates are preferably formed of magnetically soft material, such as low carbon steel. The flux plates 55 are unitary and include a base region 94 and three outwardly extending arms 96*a*, 96*b* and 96*c*. Located between the arms are slots 98*a* and 98*b* positioned so as to be alignable with the slots 91*a*, 91*b* etc. in the carriage 43 when the flux plates 55 are attached to the cross member 83 of the carriage 43 in the manner herein described. The outer ends of the arms 96*a*, 96*b* and 96*c* of the flux plate 55 are in the shape of truncated pyramids. In addition, the outer edges 100*a* and 100*b* of the two end arms 96*a* and 96*c* are undercut so that when a pair of flux plates are mounted side-by-side in the manner hereinafter described, a slot is present between the outer arms 96*a* and 96*c* of adjacent flux plates.

Located in the base region 94 of the flux plates 55 are a pair of threaded spaced-apart holes 95*a* and 95*b*. Located near the inner end of each of the arms are inner holes 97*a*, 97*b* and 97*c*. The outer two of the inner holes 97*a* and 97*c* are threaded and positioned so as to be alignable with a pair of the widely spaced holes 89*a*, 89*b*; 89*c*, 89*d*; etc., lying along the B1 axis or 89*a*', 89*b*'; 89*c*', 89*d*'; etc., lying along the B2 axis of the cross member 83 of the carriage 43. Cap screws 99 (FIG. 6) are utilized to attach the flux plate 55 to the carriage 41 via these holes. More specifically, the cap screws 99 pass through the widely spaced holes 89*a*, 89*b*, etc. in the cross member 83 of the carriage 43 and thread into the aligned threaded holes 97*a*, 97*c* located near the inner ends of the outer arms 96*a* and 96*c* of the flux plate 55. The center inner hole 97*b* is not threaded. It is included for magnetic symmetry purposes only.

Located near the outer tip of each of the arms 96*a*, 96*b* and 96*c* of the flux plates are outer threaded holes 101*a*, 101*b* and 101*c*. The outer threaded holes 101*a*, 101*b* and 101*c* are adapted to receive the threaded ends of the posts 57 of the print hammer modules in the manner herein described. The outer threaded holes 101*a*, 101*b* and 101*c* formed in the outer ends of the arms are positioned so as to align with the holes 93*a*, 93*b*, etc., and 93*a*', 93*b*', etc., lying along the C1 and C2 axes of the cross member 83 of the carriage 43 when the flux plates are attached to the carriage in the manner heretofore described.

The permanent magnet 51 is a right rectangular parallelpiped formed of permanent magnetic material as described above. The permanent magnet includes a pair of transverse slots 103*a* and 103*b* positioned so as to be alignable with the threaded holes 95*a* and 95*b* formed in the base 94 of the flux plate 55. The permanent magnet 51 is mounted on the flux plate 55 so that slots 103*a* and 103*b* are aligned with the threaded holes 95*a* and 95*b* formed in the base of the flux plate 55.

The posts 57 are cylindrical. As noted above, one end 105 of the posts 57 is threaded so as to fit into the outer threaded holes 101*a*, 101*b* and 101*c* formed in the arms 96*a*, 96*b* and 96*c* of flux plate 55. The threaded ends 105 of the posts 57 include a slot 107 (or a hex type of Allen drive aperture ) that is accessible via the holes 93*a*, 93*b*, etc. and 93*a*', 93*b*', etc., located along the C1 and C2 axes of the cross member 83 of the carriage 43, which align with the outer threaded holes 101*a*, 101*b*, and 101*c*, as previously described. The holes along the C1 and C2 axes allow a blade screwdriver access to the slots in the posts for longitudinal post adjustment, which allows the post gaps in magnetic circuits illustrated in FIG. 6 and heretofore described to be adjusted.

Mounted about each of the three posts 57 is a coil bobbin 111*a*, 111*b* and 111*c*, located near the outer ends of the posts. Thus, the coils 59, which are wrapped around the coil bobbins, are located near the outer ends of the posts 57.

As previously noted, the return plate 52 is positioned so as to lie parallel to the flux plate 55. As best illustrated in FIG. 8, the return plate 52 includes a base 112 and three arms 114*a*, 114*b* and 114*c*. The base is relatively thick when compared to the arms 114*a*, 114*b* and 114*c*, which are undercut on one face. Since the arms are only undercut on one face, the other face of the arms lies parallel to the other side of the base.

Located in the base 112 of the return plate 52 are three threaded holes 113*a*, 113*b* and 113*c*. Located in the base 112 between each pair of threaded holes 113 is one of a pair of large slots 115*a* and 115*b*. The large slots 115*a* and 115*b* are positioned so as to be alignable with the slots 103*a* and 103*b* in the permanent magnet 51 when the return plate is mounted on the permanent magnet 51 in the manner illustrated in the drawings and herein described. Large slots rather than holes are included to facilitate the formation of the return plate and to reduce magnetic cross-talk. Each of the arms 114*a*, 114*b* and 114*c* of the return plate includes a relatively thick region and an undercut outer tip 116*a*, 116*b* and 116*c*. Located between the thick region are slots 118*a* and 118*b*. As illustrated in FIG. 6, the outer tips 116*a*, 116*b* and 116*c* of the arms of the return plate 52 end a short distance from the outer tips of the posts 57 when the print modules are assembled in the manner herein described. That is, the outer tips of the arms of the return plate 52 do not overlie the tips of the posts 57. Rather, they are offset a predetermined distance from the tips of the posts, in the direction of the permanent magnet 51. Finally, the undercut side of the arms 114*a*, 114*b* and 114*c* of the return plate 52 face away from the permanent magnet 51.

As noted above, each hammer module 45 includes three print hammers 47. The print hammers are formed by a hammer assembly 53 comprising three arms 65 having a unitary base 63 and three stiffeners 67. Formed in the base 63 are five holes 119*a*, 119*b*, 119*c*, 119*d* and 119*e* positioned so as to be aligned with the three holes and two slots in the base 112 of the return plate 52. The hammer arms 65 are positioned so as to lie parallel to the arms of the return plate 51 when the five holes in the base of the hammer and the return plate are suitably aligned. The outer tips of the hammer arms 65 are truncated. Mounted on the outer tips of the hammer arms 65 are the stiffeners 67. As illustrated in FIG. 8, the stiffeners have undercut ends that overlie the tips of the arms 65. The tips of the undercut ends of the stiffeners 67 are tapered on one side. The region where the stiffeners 67 overlie the tips of the arms 65 is attached to the arms by any suitable means, such as welding, for example. The end of the stiffeners 67 remote from the point from attachment to the arms 65 curves inwardly and terminates in an outwardly projecting tip 121. The outwardly projecting tip 121 of the stiffeners 67 are undercut on theside facing the hammer arms 65. Mounted on the face of the tips of the stiffeners 67 facing away from the hammer arms 65 are the anvils 49.

As illustrated in FIG. 8, the clamp 71 is an elongated piece of metal with five holes 123*a*, 123*b*, 123*c*, 123*d*, and 123*e* spaced along its longitudinal length. The five holes are positioned so as to be alignable with the five holes 119*a*, 119*b*, 119*c*, 119*d* and 119*e* in the base 63 of the hammer assembly 53, when the clamp 71 overlies the base of the hammer assembly. Three countersunk cap screws 127*a*, 127*b* and 127*c* (FIG. 7) pass through the center and the two outer holes in the clamp 71 and the base 63 of the hammer assembly 53 and thread into the threaded holes 113*a*, 113*b* and 113*c* in the base of the return plate 52. Thus, the clamp 71 and short cap screws 127*a*, 127*b* and 127*c* affix the hammer assembly 53 to the return plate 52. When so affixed, the hammer arms 65 lie parallel to the arms 114*a*, 114*b* and 114*c* of the return plate 52. The undercut region of the arms of the return plate 52 provide a space between the hammer arms and the return plate arms.

The bolted together clamp 71, hammer 47 and return plate 52 are positioned such that the holes between the short cap screw holes are aligned with the slots 103*a* and 103*b* in the permanent magnet 51, which in turn, are aligned with the threaded holes 95*a* and 95*b* formed in the base 94 of the flux plate 55, as previously described. The relatively long cap screws 73 pass through these aligned holes and slots and thread into the threaded holes 95*a* and 95*b* in the base of the flux plate 55. During assembly, preferably, the printer modules formed of the flux plate 55, the posts 57, the coil support 109, the coils 59, the permanent magnet 51, the return plate 52, the hammer assembly 53 and the clamp 71 are first assembled. Thereafter, the modules are attached to the carriage 43 in the manner heretofore described by cap screws 99. Preferably the permanent magnets 51 are not magnetized until after the modules are assembled (but before mounting on the carriage) to provide for ease of relative part movement during alignment due to the absence of magnetic attraction.

As will be readily appreciated from the foregoing description, the invention provides a new and improved dot printing mechanism suitable for use in a dot matrix line printer. Preferably, the separation between the anvils 69 is such that as the carriage is oscillated back and forth, one anvil covers two character positions. Thus, if a complete line of characters is to comprise 132 character positions, 66 hammers would be mounted on the carriage 11. Assuming each printer module has three hammers and half are mounted on each side of the carriage, a complete dot printing mechanism would include eleven (11) modules mounted on each side of the carriage centerline A, or a total of twenty-two (22) printer modules.

While a preferred embodiment of the invention has been illustrated and described, it will be appreciated that various changes can be made therein without departing from the spirit and scope of the invention. Hence, the invention can be practiced otherwise than as specifically described herein.

The embodiments of the invention in which an exclusive property or privilege is claimed are defined as follows:

1. A dot printing mechanism for dot matrix line printers comprising:

(A) a carriage;

(B) support means for supporting said carriage for oscillatory movement along a print line;

(C) oscillation means coupled to said carriage for oscillating said carriage along said print line; and, (D) two elongate print hammer mechanisms mounted on said carriage, each of said elongate print hammer mechanisms comprising:

(1) an elongate permanent magnet, said elongate permanent magnet being transversely polarized with respect to the longitudinal axis of said elongate permanent magnet such that said elongate permanent magnet has a pair of opposed polarized faces lying parallel to the longitudinal axis of said elongate permanent magnet;

(2) a flux plate formed of a magnetically permeable material mounted (3) a plurality of coil posts, formed of a magnetically permeable material, mounted on the outer end of said flux plate so as to overlie said elongate permanent magnet;

(4) a plurality of coils, one of said coils mounted on each of said coil posts;

(5) a return plate formed of a magnetically permeable material mounted on the other polarized face of said elongate permanent magnet and extending outwardly therefrom so as to lie parallel to said flux plate, said return plate terminating short of said plurality of posts so that gaps exist there between; and, (6) a print hammer assembly mounted on the side of said return plate remote from the side mounted on said permanent magnet, said print hammer assembly including a plurality of hammer arms formed of a resilient material and a plurality of stiffeners formed of a magnetically permeable material, one of said stiffeners mounted on the end of each of said hammer arms, said plurality of hammer arms and stiffeners being equal to said plurality of posts, one of said hammer arms and stiffeners being aligned with each of said posts and extending from the area where said print hammer assembly is mounted on said return plate to the tip of said aligned post such that said stiffener lies in the gap between said return plate and said aligned post, said hammer arms and stiffeners being attracted to their aligned posts by the magnetic field produced by said permanent magnet in the absence of current through said coils, said attraction force overcoming the resilient force of said hammer arms, each of said stiffeners including a dot printing anvil located on the side of said stiffener remote from the side facing said aligned post;

said two elongate print hammer mechanisms being mounted on said carriage such that said stiffeners are interleaved so that said dot printing anvils are aligned along a common print line.

2. A dot printing mechanism for dot matrix line printers as claimed in claim 1 wherein said two elongate print hammer mechanisms are each formed of a plurality of print modules.

3. A dot printing mechanism as claimed in claim 2 wherein said coils are located near the outer end of said posts.

4. A dot printing mechanism as claimed in claim 2 wherein said print hammer arms are joined together via a common, unitary base.

5. A dot printing mechanism as claimed in claim 2 wherein said flux plate includes a base and a plurality of outwardly extending arms separated by slots, said base being mounted on said one polarized face of said permanent magnet, said coil posts being mounted on the ends of said outwardly extending arms.

6. A dot printing mechanism as claimed in claim 2 wherein said return plate includes a base and a plurality of outwardly extending arms, said base being mounted on said other polarized face of said permanent magnet, said arms being undercut on the side thereof remote from said permanent magnet, said arms being equal in number and aligned with said coil posts.

7. A dot printing mechanism as claimed in claim 1 wherein said coils are located near the outer end of said posts.

8. A dot printing mechanism as claimed in claim 1 wherein said print hammer arms are joined together via a common, unitary base.

9. A dot printing mechanism as claimed in claim 1 wherein said flux plate includes a base and a plurality of outwardly extending arms separated by slots, said base being mounted on said one polarized face of said permanent magnet, said coil posts being mounted on the ends of said outwardly extending arms.

10. A dot printing mechanism as claimed in claim 9 wherein said return plate includes a base and a plurality of outwardly extending arms, said base being mounted on said other polarized face of said permanent magnet, said arms being undercut on the side thereof remote from said permanent magnet, said arms being equal in number and aligned with said coil posts.

11. A dot printing mechanism as claimed in claim 1 wherein said return plate includes a base and a plurality of outwardly extending arms, said base being mounted on said other polarized face of said permanent magnet, said arms being undercut on the side thereof remote from said permanent magnet, said arms being equal in number and aligned with said coil posts.

12. In a dot matrix line printer wherein a line of dot printing elements are oscillated back and forth along a print line, the improvement comprising:

a plurality of print modules mounted side-by-side along said print line, each of said print modules including a print hammer assembly, each print hammer assembly including a plurality of hammer arms formed of a wide, flat piece of resilient material and a plurality of stiffeners formed of a relatively large bulky mass of magnetically permeable material, one of said stiffeners mounted on the outer end of each of said hammer arms, said stiffeners having anvils located on one face and near the outer ends thereof, said anvils located along said print line, said modules mounted on opposite sides of said print line such that said anvils are interleaved.

13. The improvement claimed in claim 12 wherein each of said print modules also includes:

an elongate permanent magnet, said elongate permanent magnet being transversely polarized with respect to the longitudinal axis of said elongate permanent magnet such that said elongate permanent magnet has a pair of opposed polarized faces lying parallel to the longitudinal axis of said elongate permanent magnet;

a plurality of posts formed of a magnetically permeable material and equal in number to said number of print hammers, one of said posts aligned with the outer end of each of said hammer arms and stiffeners so as to face the side of said stiffener opposite the side on which said anvils are mounted;

magnetic circuit means for coupling said opposed polarized fares of said elongate permanent magnet to said print hammer assemblies and said posts such that said outer ends of said print hammer assemblies are attached to said posts; and, a plurality of release coils, one of said release coils mounted on each of said posts.

14. The improvement claimed in claim 13 wherein said print hammer arms are joined together via a unitary common base.

15. The improvement claimed in claim 13 wherein said magnetic circuit means includes a flux plate formed of a magnetically permeable material.

16. The improvement claimed in claim 13 wherein said flux plate includes a base and a plurality of outwardly extending arms separated by slots, said base being mounted on one polarized face of said permanent magnet, said coil posts being mounted on the ends of said outwardly extending arms.

17. The improvement claimed in claim 16 including a return plate formed of a magnetically permeable material mounted on the other polarized face of said permanent magnet and lying parallel to said flux plate and between said permanent magnet and said print hammer arms.

18. The improvement claimed in claim 17 wherein said return plate includes a base and a plurality of outwardly extending arms, said base being mounted on said other polarized face of said permanent magnet, said arms being undercut on the side thereof remote from said permanent magnet, said arms being equal in number and aligned with said coil posts.

19. The improvement claimed in claim 13 wherein said magnetic circuit includes a return plate formed of a magnetically permeable material mounted on one polarized face of said permanent magnet and lying between said permanent magnet and said print hammer assemblies.

20. The improvement claimed in claim 14 wherein said return plate includes a base and a plurality of outwardly extending arms, said base being mounted on said one polarized face of said permanent magnet, said arms being undercut on the side thereof remote from said permanent magnet, said arms being equal in number and aligned with said coil posts.

* * * * *

UNITED STATES PATENT AND TRADEMARK OFFICE

CERTIFICATE OF CORRECTION

PATENT NO. : 4,351,235

DATED : September 28, 1982

INVENTOR(S) : Edward D. Bringhurst

It is certified that error appears in the above—identified patent and that said Letters Patent is hereby corrected as shown below: On the title page:

| | |
|---|---|
| Abstract, line 23 | After "energization" insert -- of --; |
| Column 10, line 53 | After "mounted" insert -- on one of said polarized faces of said elongate permanent magnet and extending outwardly therefrom; -- ; |
| Column 12, line 41 | Delete "fares" and insert --faces--. |

Signed and Sealed this

*Eighth* Day of *March 1983*

[SEAL]

*Attest:*

GERALD J. MOSSINGHOFF

*Attesting Officer*

*Commissioner of Patents and Trademarks*